United States Patent [19]

Kistner

[11] Patent Number: 5,013,621

[45] Date of Patent: May 7, 1991

[54] ONE-PART WHITE REFLECTIVE COATING

[75] Inventor: John F. Kistner, Oakdale, Minn.

[73] Assignee: Minnesota Mining and Manufacturing Company, St. Paul, Minn.

[21] Appl. No.: 512,948

[22] Filed: Apr. 23, 1990

[51] Int. Cl.[5] ..... G03C 1/76; G03C 1/96; G03C 7/14; G03C 9/00

[52] U.S. Cl. ..... 430/11; 430/14; 430/15; 430/22; 430/357; 430/394; 430/510; 430/946; 430/950; 430/961; 430/536

[58] Field of Search ..... 430/11, 14, 15, 946, 430/950, 961, 510, 22, 357, 394, 935, 536

[56] References Cited

U.S. PATENT DOCUMENTS

| | | | |
|---|---|---|---|
| 3,751,258 | 8/1973 | Howe et al. | 430/946 |
| 4,629,667 | 12/1986 | Kistner et al. | 430/946 |
| 4,885,332 | 12/1989 | Bilkadi | 524/714 |
| 4,906,523 | 3/1990 | Bilkadi et al. | 428/327 |

*Primary Examiner*—Richard L. Schilling
*Attorney, Agent, or Firm*—Gary L. Griswold; Walter N. Kirn; Mark A. Litman

[57] ABSTRACT

A one-part coating composition for the backside of photographic prints and photographic prints so coated are described. The white coating is reflective, flexible, and water resistant.

7 Claims, No Drawings

ONE-PART WHITE REFLECTIVE COATING

BACKGROUND OF THE INVENTION

1. Field of the Invention

Three-dimensional, autostereographic prints with lenticular surfaces are described. Reflective backside coating compositions and processes essential to the manufacture of the three-dimensional prints are also described.

2. Background of the Art

Stereo-optical images have been available for many years. Almost all of them are based upon the same principle of displaying multiple images (i.e., at least two images) at the same time, each image displaying the same scene from a different perspective, approximating the different perspectives that would be seen by the left and right eye. Each image is then simultaneously displayed in a manner that enables each eye to view its appropriate image. With each eye receiving an image with an appropriate perspective, a scene with natural depth to it is seen.

The old 'stereopticons' and modern three-dimensional viewers for children provide separate images which are viewed through separate eyepieces to provide the different perspectives. More modern three-dimensional photographic images, such as that shown in U.S. Pat. No. 3,751,258 have a lenticular surface over multiple images. The optical effect of the lenticles is to direct the transmitted optical images towards the appropriate viewing eye. U.S. Pat. No. 3,751,258 requires that a reflective backing layer be attached to the radiation-sensitive element and that the reflective backing layer be permeable to the baths or other means required to process the radiation-sensitive element to a visible image. The properties necessary in formulating a reflective backing layer with those properties has proven to be difficult to achieve in actual practice. A presently commercial embodiment of this technology has between ten and twelve layers coated onto the lenticular surface and requires two or three passes on coating apparatus to lay those layers onto the surface. That is a complex and expensive procedure.

U.S. Pat. No. 4,629,667 describes a radiation curable reflective coating composition for the backside of photographic prints. These compositions contain white pigment, crosslinkable water-soluble binder, and crosslinking agent for the binder.

SUMMARY OF THE INVENTION

According to the present invention, a radiation-sensitive image forming means is coated onto a lenticular surface and no reflective backing layer is initially present. After complete development of the image, the reflective backing layer is coated over the image. The coating composition and the final coating must have particular properties in order to provide the optical properties necessary in the backing without adversely affecting the finished image.

DETAILED DESCRIPTION OF THE INVENTION

The present invention describes a three-dimensional autostereographic print having a coated reflective backing on the side of the image containing layer or layers away from the lenticular surface of the print. The present invention also describes a process for making such an autostereographic print by first developing the multiple perspective image and the coating the backside of the image with a reflective coating composition. Coating compositions useful in providing the reflective backside coating are also described as part of the present invention.

The printing stock used in the practice of the present invention comprises a lenticular surface having a multiplicity (at least two) of perspective images of the same scene in optical registry with the refractive ability of the lenticular surface. The images may be in black-and-white or in color and may be in any format (e.g., silver halide photographic images, photographic dye images, printed images, photothermographic images, diazo images, electrophotographic images, etc.). Preferably the images are color photographic images in hydrophilic colloid binders such as gelatin. The perspective images may be in one or more layers which constitute the image medium. One surface of the image medium faces or is bonded to the non-lenticular face of the lenticular element forming the viewing surface. Layers intermediate to the lenticular element and the image medium may be present to enhance bonding (e.g., primer or spacer layers) or to provide additional optical effects, but in general the optical element will be directly bonded to the lenticular element or with at most a protective or adhesion enhancing layer between them. The side of the optical element facing the lenticular layer is referred to as the front side of the optical element and the other side is referred to as the backside of the optical element.

Ordinarily and in the preferred mode of practicing the present invention, the optical element is transparent except for the presence of materials which constitute the image. For example, photographic image containing optical elements would comprise hydrophilic colloidal binder with only dyes and/or silver present as visually observable components within the optical element. Printed images or electrophotographic images would be made on transparent polymeric film. Once the image containing optical element is engaged with the lenticular surface, the reflective coating is then applied to the backside of the optical element to provide a three-dimensional, autostereographic print viewable by reflective lighting.

The physical and optical properties for the reflective coating are critical to the performance and durability of the print. The required combination of properties are not easily achieved and the particular properties needed to practice the above-described technology have not been previously recognized in the art. Particularly when used in combination with photographic images in the optical element, the requirements of the coated reflective layer and the coating composition used to make that layer are stringent.

To be used with finished images and particularly photographic images in the optical element, the coating composition must have at least the following properties:

(1) A water-based binder composition (i.e., with less than 4% by volume of any volatile organic solvents for photographic dyes), (2) Good adhesion characteristics to hydrophilic colloid layers, and (3) Non-reactive with the photographic image.

Additionally, the dried reflective backing layer must have the properties necessary to perform its function, including:

(1) Reflectivity, (2) Desired degree of opacity, (3) Adhesion to the substrate,
(4) Water-insolubility,
(5) Flexibility, and desirably (but not essentially)
(6) Dryability to a water-insoluble coating at relatively low temperatures (60°-90° C.) over a short period of time (2-5 minutes).

These combinations of properties and the changes in properties from the coating composition (e.g., water-based) to the dried reflective layer (e.g., water-insoluble) are not easily achieved. The present invention describes compositions which are able to perform all of these requirements and provide improvements over prior compositions.

The coating compositions described in U.S. Pat. No. 4,629,667 require the use of a catalyst to cause cross-linking to occur and insolubility to result during the drying state. Such two-part systems have the disadvantage that:

(1) the catalyzed mixture has a finite pot life,
(2) the physical properties (e.g., viscosity) of the catalyzed mixture continually change with time,
(3) unused catalyzed material must be discarded (cannot be saved).

The coating compositions of the present invention are one-part in nature, and do not require addition of a catalyst before use. Consequently, these compositions have no limitation on their pot life, but rather have stable properties throughout their use and minimize waste because unused portions can be saved and used over again at a later time. These compositions comprise at least the following components:

| | |
|---|---|
| 60.3 | Distilled water |
| 35.5 | Titania |
| 3.7 | Acrylic emulsion |
| 0.4 | Dispersant |
| 0.1 | Thickener |

White particulate reflective pigments are well known in the imaging technologies. Titania pigments are by far the pigment of choice because of their high reflectivity. U.S. Pat. No. 3,751,258 discloses the use of titania pigments as well as zinc oxide and barium sulfate. Lamellar titania flakes with high aspect ratios and enhanced reflectivity are also known to be used as reflective pigments (e.g., 4,216,018). Calcium carbonate and other metal oxides are also available as white pigments, alone or in combination with titania.

The polymeric binders of this invention are water-insoluble, but are suspended as tiny particles in water as a dispersion or emulsion. When the water carrier is evaporated away, the polymer particles fuse together to form a continuous water-insoluble film. While many polymer emulsions can be found which will give some of the physical properties required for application on photographic substrates (previously listed), very few will satisfy all the requirements. One of the most difficult requirements to satisfy is photo-inertness. Upon contact, most organic polymers react with the sensitive dyes of the various photographic layers so that color shifts occur; this results in a photograph with an off-hue, or a background stain, and is a totally unacceptable condition.

I have found that certain polymers of the acrylate class (including copolymers and methacrylates) will meet all the requirements for successful application. Included with the class poly(acrylates) are acrylates, methacrylates and copolymers thereof such as poly (styrene/acrylates). Acrylate monomers useful for the preparation of the binders for the present invention include, for example, acrylic acid, butyl acrylate, 2-ethyl hexyl acrylate, and the corresponding methacrylate analogs.

The binder of choice is an acrylic polymer emulsion with a molecular weight greater than 200,000. To meet the flexibility requirements, the Tg of the polymer should be below 50° C., and preferably below 30° C. When dried, the polymer forms a film with good water resistance.

Most emulsions use high boiling organic liquids to help the polymer particles fuse together during dry down; these film forming aids are sometimes called "coalescing solvents", and can be present at concentrations of 10-20% by weight based on the polymer solids. It is important that coalescing solvents be kept to a minimum (less than 10%, preferably less than 5%) and more preferably not be used at all (0% or less than 1%) in the practice of this invention because their presence often cause dye migration within the photographic layers, and result in undesirable bleeding of dyes into the reflective backcoat.

Emulsions of acrylate polymers and copolymers useful in the practice of this invention are commercially available under the names Unocal 1019 and 1018 (Union Oil Co. of Calif.), Joncryl 74, 77 and 538 (S.C. Johnson Co.), Ucar 351 and 376 (Union Carbide), and Darex WW10 and Daran SL-143 (W.R. Grace). These emulsions may be used separately or in various combinations to get the final properties desired.

Optionally, dispersants may be used to stabilize pigment dispersion, and prevent pigment flocculation. If a dispersant is used, one must be selected that does not interfere with the photographic layers. Also the viscosity of the coating composition may be adjusted by use of thickeners, and surfactants may be employed to accomplish good wetting and levelling characteristics. Water-soluble surfactants are very useful as coating aids. They assist in the formation of smooth, bubble-free reflective coatings. There are many water-soluble surfactants commercially available, particularly poly(dimethyl silicone) alcohols such as surfactant DC-193 (Dow Corning).

A general range by weight for the required components of the basic coating composition of the present invention is 40-90% of water, 20-50% white pigment (for reflective viewing), and 0.1 to 20% for transmissive viewing), 0.1 to 20% binder. A preferred range would be 50-80% water, 20-45% white pigment, 1 to 15% polymeric binder.

A general composition range by weight for preferred coatings according to the present invention would be 40-90% water, 20-50% white pigment, 0.1 to 20% water-insoluble polymer binder.

The final coating of the present invention would have most or substantially all of the water removed therefrom (except that generally in equilibrium with the environment). The proportions by weight of materials in the dried film would generally be 80-99.5% white pigment (for reflective viewing), 0.25-40% white pigment (for transmissive viewing), and the remainder (0.5-99.75%) is synthetic polymeric binder.

Certain terms used in describing the properties of the present invention have definite meanings in the art. When the final print is described as flexible, this means that it can conform to a mandrel having a diameter of three (3) inches (7.6 cm) without cracking. Preferred constructions in the practice of the present invention can conform to mandrels with less than 5 mm diameters without cracking of the coated reflective layer. When the integrity of the coated reflective layer is mentioned, it is meant that after mild rubbing to remove processing residues, the coating layer will not readily be removed by handling. This means that if the print is gripped between a thumb and index finger with a force of 1 to 2 lbs per 7 square inch (70 to 140 g/cm$^2$) and the print is pulled away from between the fingers, that less than 1% of the coating would be removed. Water-repellancy means that when a drop of water is placed on the backing layer and wiped away within five seconds with a soft tissue, there has been no permanent visible effect upon the image in the optical layer on either side of the print.

The reflective backing layer can be either substantially opaque or translucent. If the layer is opaque it is viewable only be reflective illumination. If it is translucent, it is viewable by either reflected or transmitted light. A translucent backing may allow up to 90% of transmitted visible radiation through the layer and still provide a print viewable by reflected light. Preferably the backside reflective coating allows no more than 50% transmission of light. More preferably it allows no more than 20% transmission of light, and most preferably the reflective layer allows no more than 15% transmission of visible light.

The physical construction of the present article, in having the dried, water-insoluble polymer backing layer over the emulsion, has a number of resultant advantages. Corrective tints can be easily added to the backcoating to correct for small deviations in color rendition due to the negative, the imaging system in the optical element, or lighting during the original image recordation. Conventional photographic dyes or whiteners can be added to the reflective layer to accomplish this. The present construction can provide a thicker, more stable and more reflective backing layer. The previous constructions required a thin pigmented layer to enable penetration of the layer by the developer. Because the layers were previously thin, there was less available pigment for providing a white background. The reflective backing of the present invention can be as thick as desired since they are provided after the image is present in its finished state on the back of the lenticular element. Ordinarily the reflective backing layer is from $1\times10^{-5}$ to $1\times10^{-3}$ meters thick, preferably between $1.5\times10^{-5}$ and $2\times10^{-4}$ meters. The reflective backing can also be made water-repellant while backing layers on previous photographic constructions had to be readily penetrable by aqueous solutions. The water-repellancy of the present construction reduces the likelihood of subsequent damage to the print by aqueous solutions.

The following discussion provides a description of useful process conditions for applying the composition of the present invention to a print associated with a lenticular viewing layer. To begin the process, a multiplicity of finished perspective images in a layer of multiplicity of layers forming an optical element are secured to the back surface of a lenticular element or lenticular sheet. The association of the perspective images with the lenticular element at this point provides an autostereoscopic article viewable by transmission of light. A lenticular surface of the lenticular element is away from the side of the lenticular element carrying the perspective images. The coating composition is then applied as a liquid coating on the available surface of the optical element. The coating is then dried (preferably at elevated temperatures such as 65°-95° C., more preferably 70°-85° C.) to remove at least 80% of the water. Preferably more than 90% of the water is removed. Total combined drying and curing time may range from about two to eight minutes depending upon the thickness of the coating and the temperatures used to dry the coating.

A dried and crosslinked product of the composition comprising by weight 0.1 to 50% of a white pigment, 0.1 to 20% of a water-insoluble synthetic polymeric binder, and 40 to 90% water is formed.

These and other aspects of the present invention will be illustrated by the following non-limiting example.

EXAMPLE

A lenticular sheet of cellulose acetate having a thickness of about 0.25 mm was embossed to form cylindrical lenticules having diameters of about 0.2 mm in diameter. This provided approximately 150 lenticules per inch on the front surface of the lenticular sheet. The back surface of the lenticular sheet was coated with a conventional negative acting tri-pack construction of color-forming silver halide/gelatin emulsion layers as generally used in the manufacture of color photographic paper stock. The layers comprised, in order from the backside of the lenticular sheet:

(1) a red-sensitive silver halide/gelatin emulsion containing a magenta dye-forming coupler, (2) a gelatin interlayer, (3) a green-sensitive silver halide/gelatin emulsion containing a cyan dye-forming coupler, (4) a gelatin spacer layer containing an ultraviolet radiation absorbing compound, (5) a blue-sensitive silver halide/gelatin emulsion containing a yellow dye-forming layer, and (6) a gelatin Protective layer.

The dried and coated emulsions on the lenticular sheet were exposed to light through photographic negatives of two perspective images. The emulsions were then developed, bleached and fixed according to standard color photographic procedures. At this point the article provided a three-dimensional, autostereographic article viewable by transmissive illumination.

The gelatin protective layer is then coated with a $7.6\times10^{-5}$ meter wet coating to a composition comprising in parts by weight

| | |
|---|---|
| 60.3 | Distilled water |
| 35.5 | Titania |
| 3.7 | Acrylic emulsion |
| 0.4 | Dispersant |
| 0.1 | Thickener |

I claim:

1. An autostereographic print comprising a lenticular element having a lenticular front surface and a non-lenticular back surface, secured to said non-lenticular back surface one surface of a transparent optical element having at least two perspective images, and secured to the other surface of said optical element a backing layer comprising the dried and water repellant product of a composition comprising by weight:

0.1 to 50% of a white pigment, 0.1 to 20% of a water-insoluble synthetic polyacrylate polymeric binder, and 40 to 90% water.

2. The print of claim 1 wherein said optical element comprises a color photographic image.

3. The print of claim 2 wherein said backing layer comprises 0.25 to 99.5% white pigment, 0.5 to 99.75% water-insoluble acrylate polymeric binder.

4. The print of claim 3 wherein said backing layer further comprises 0.1 to 5% dispersant, and 0.1 to 5% thickener.

5. A process for producing an autostereographic print comprising (a) providing at least two perspective images in an optical element which is secured to a non-lenticular surface of a lenticular sheet, (b) coating the surface of said optical element which is not secured to said lenticular sheet with a composition comprising by weight

| | |
|---|---|
| 50–68 | Distilled water |
| 30–40 | Titania |
| 1–7 | Acrylic emulsion |
| 0.1–1 | Dispersant |
| 0.02–1 | Thickener |

and (c) drying said composition.

6. The print of claim 1 wherein said water-insoluble synthetic polymeric binder is a polymer or copolymer of an acrylate ester, and has a mol. wt. greater than 200,000.

7. The process of claim 5 wherein said water-insoluble synthetic polymeric binder comprises a polymer or copolymer of an acrylate ester, and has a molecular weight greater than 200,000.

* * * * *

UNITED STATES PATENT AND TRADEMARK OFFICE

CERTIFICATE OF CORRECTION

PATENT NO. : 5,013,621

DATED : May 7, 1991

INVENTOR(S) : Kistner

It is certified that error appears in the above-identified patent and that said Letters Patent is hereby corrected as shown below:

Col. 5, line 10, Delete one -- 7 -- after "per"

Signed and Sealed this

Sixteenth Day of November, 1993

*Attest:*

Bruce Lehman

BRUCE LEHMAN

*Attesting Officer*

*Commissioner of Patents and Trademarks*